US008514142B1

(12) United States Patent
Doane

(10) Patent No.: US 8,514,142 B1
(45) Date of Patent: Aug. 20, 2013

(54) RECONFIGURABLE SURFACE REFLECTOR ANTENNA

(75) Inventor: Jonathan P. Doane, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 829 days.

(21) Appl. No.: 12/313,883

(22) Filed: Nov. 25, 2008

(51) Int. Cl.
*H01Q 19/10* (2006.01)

(52) U.S. Cl.
USPC ..... 343/818; 343/799

(58) Field of Classification Search
USPC ..... 343/893, 818, 799
See application file for complete search history.

(56) References Cited

U.S. PATENT DOCUMENTS

| | | | | |
|---|---|---|---|---|
| 6,407,719 | B1 * | 6/2002 | Ohira et al. | 343/893 |
| 6,987,493 | B2 * | 1/2006 | Chen | 343/893 |
| 7,636,070 | B2 * | 12/2009 | De Lustrac et al. | 343/909 |
| 2003/0013408 | A1 * | 1/2003 | Blodgett et al. | 455/3.01 |
| 2003/0193446 | A1 * | 10/2003 | Chen | 343/893 |
| 2005/0212714 | A1 * | 9/2005 | Chiang et al. | 343/810 |
| 2008/0122728 | A1 * | 5/2008 | Philippakis | 343/876 |

* cited by examiner

*Primary Examiner* — Hoanganh Le
(74) *Attorney, Agent, or Firm* — Donna P. Suchy; Daniel M. Barbieri

(57) ABSTRACT

The present invention is an electronically scannable antenna. The antenna includes a Radio Frequency (RF) element. The antenna also includes a screen which is configured at least substantially around the RF element. The screen includes a plurality of integrated switches which may be configured to allow the operating mode of the screen to be selectively and automatically switched between a transmissive mode and a reflective mode. When the screen is operating in the transmissive mode, the antenna is configured to provide an omnidirectional beam. When the screen is operating in the reflective mode, the antenna is configured to provide a directional beam.

7 Claims, 5 Drawing Sheets

Directional Mode:
Beam position determined by state of reconfigurable surface

Omnidirectional Mode:

RECONFIGURABLE SURFACE REFLECTOR ANTENNA

FIELD OF THE INVENTION

The present invention relates to the field of Radio Frequency (RF) devices and particularly to a reconfigurable surface reflector antenna.

BACKGROUND OF THE INVENTION

A number of current RF devices may not provide a desired level of performance.

Thus, it would be desirable to provide an RF device (ex.—antenna) which provides a desired level of performance.

SUMMARY OF THE INVENTION

Accordingly, an embodiment of the present invention is directed to an antenna, including: an element; and a screen, the screen being configured at least substantially around the element, wherein the screen includes switching means for allowing an operating mode of the screen to be selectively switched between a transmissive mode and a reflective mode, wherein the antenna is configured to provide an omni-directional beam when the screen is operating in the transmissive mode, the antenna being further configured to provide a directional beam when the screen is operating in the reflective mode.

An additional embodiment of the present invention is directed to an electronically scannable antenna, including: a Radio Frequency (RF) element; and a screen, the screen being configured at least substantially around the RF element, the screen including a plurality of integrated switches, the integrated switches configured for allowing an operating mode of the screen to be selectively and automatically switched between a transmissive mode and a reflective mode, wherein the antenna is configured to provide an omni-directional beam when the screen is operating in the transmissive mode, the antenna being further configured to provide a directional beam when the screen is operating in the reflective mode.

A further embodiment of the present invention is directed to a reconfigurable antenna, including: an isotropic Radio Frequency (RF) element; and a metallic screen, the metallic screen being configured at least substantially around the isotropic RF element, the metallic screen including a plurality of PIN diodes, the plurality of PIN diodes configured for allowing an operating mode of the screen to be selectively and automatically switched between a transmissive mode and a reflective mode, wherein when the screen is in transmissive mode, the PIN diodes of the screen are non-conducting, thereby preventing current flow along the metallic screen and allowing incident RF to pass through the metallic screen, wherein when the screen is in reflective mode, the PIN diodes of the screen are conducting, thereby allowing current flow along the metallic screen and causing incident RF to be reflected, wherein the antenna is configured to provide an omni-directional beam when the metallic screen is operating in the transmissive mode, the antenna being further configured to provide a directional beam when the metallic screen is operating in the reflective mode.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Electronically steerable antennas may be implemented with phased arrays. However, implementing electronically steerable antennas with phased arrays may result in antennas which are costly, have a limited field of view, and cannot excite an omni-directional beam. For instance, a number of electronically steered arrays, such as flat or conformal arrays, may be limited in their scan volume (ex.—may often be ±fifty (50) degrees from normal). Further, a number of electronically steered arrays may require complicated, expensive and lossy feed networks to distribute Radio Frequency (RF) to each element. Additionally, a number of electronically steered arrays may require expensive, bulky and lossy phase shifters at every column for a one-dimensional (1D) scan. Still further, it may be challenging for a number of circular arrays and near-impossible for a number of flat and conformal arrays to operate in omni-directional modes. Further, a number of antennas may utilize multiple driven elements. Other antennas may be waveguide-fed and may utilize mechanical switching. The present invention provides an electronically scannable antenna which provides omni-directional and directional beams with a three hundred-sixty (360) degree field of view.

Figure 3:
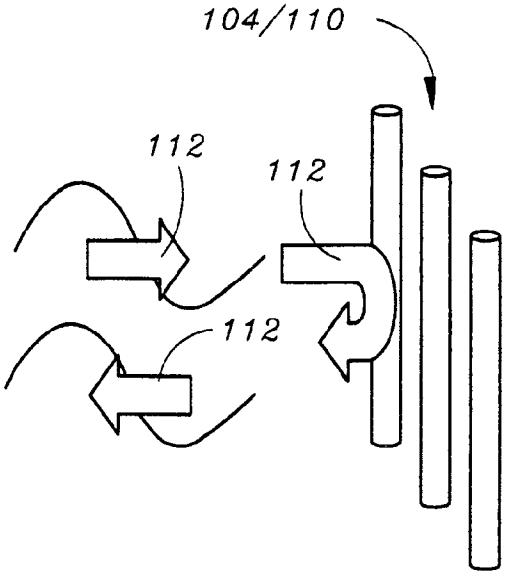
FIG. 3 is a flow schematic illustrating a reconfigurable surface/screen of a reconfigurable antenna of the present invention, said screen being in a reflective mode, wherein incident RF is reflected by said screen as shown, in accordance with an exemplary embodiment of the present invention.
Figure 4:
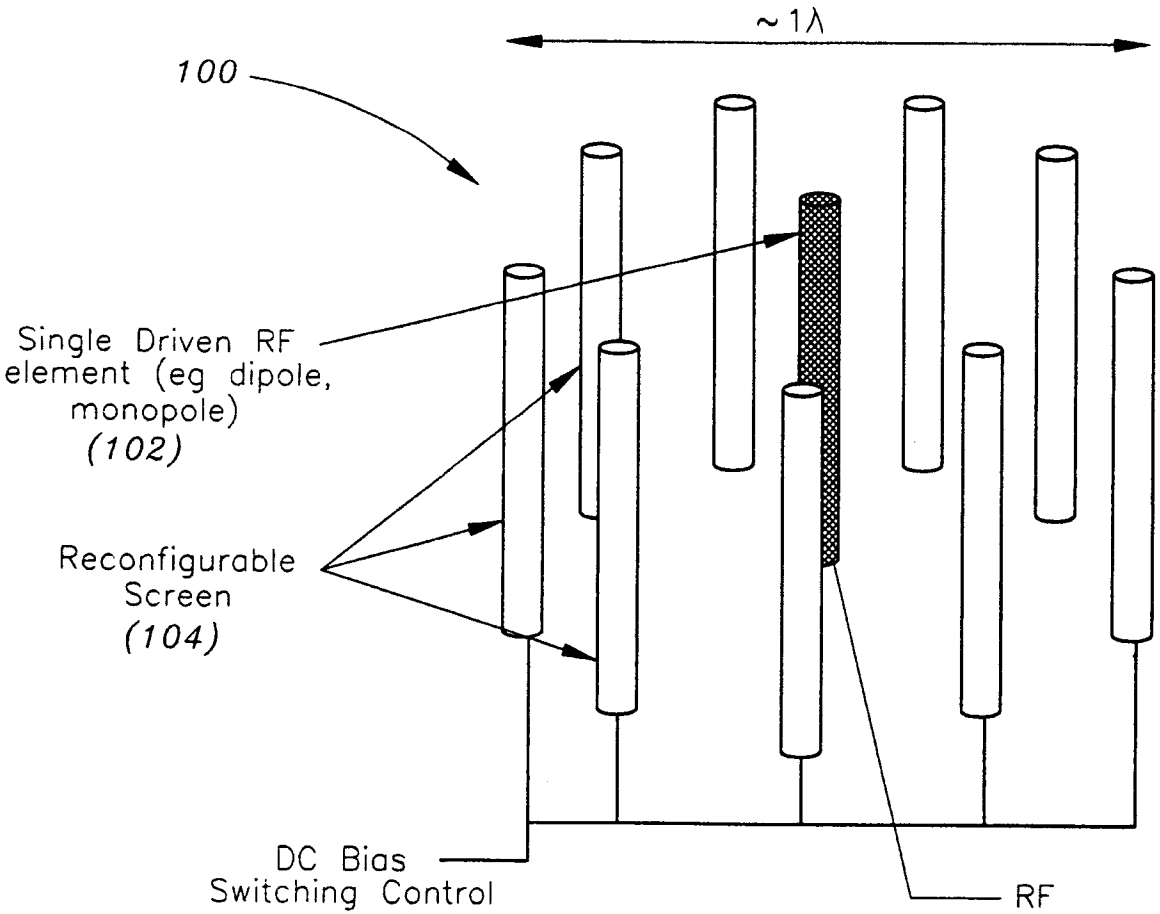
FIG. 4 is a view of a reconfigurable antenna in accordance with an exemplary embodiment of the present invention.

Referring generally to FIGS. 1-7, an antenna, such as a communications antenna, in accordance with an exemplary embodiment of the present invention is shown. In a current embodiment of the present invention, the antenna 100 may include an element 102 (as shown in FIG. 4). For example, the element 102 may be a single driven element, such as a Radio Frequency (RF) element. In further embodiments, the element 102 may be an isotropic element. In exemplary embodiments, the element 102 may be an omni-directional element (ex.—may be a monopole or a dipole).

In exemplary embodiments of the present invention, the antenna 100 may include a reconfigurable surface 104 (as shown in FIG. 4). For instance, the reconfigurable surface 104 may be a screen, such as a screen formed of metal (ex.—a metallic screen). In current embodiments of the present invention, the screen 104 may be configured at least substantially around the element 102. For example, the screen 104 may surround the element 102 (as shown in FIGS. 4-7).

Figure 2:
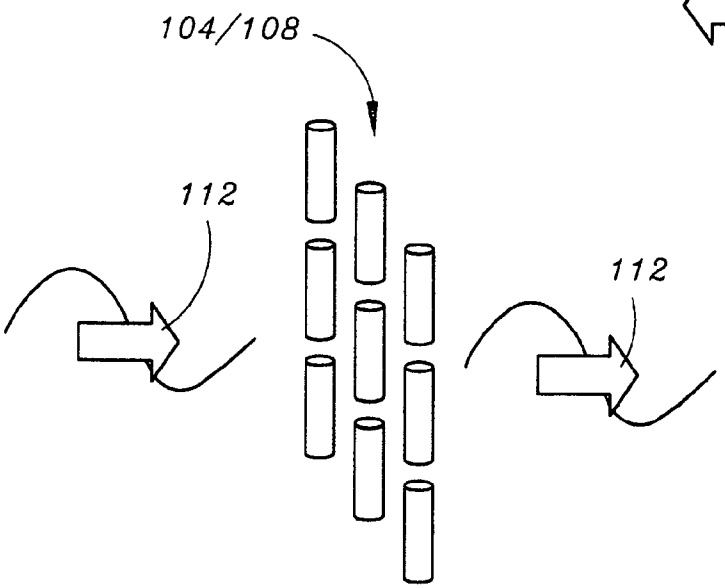
FIG. 2 is a flow schematic illustrating a reconfigurable surface/screen of a reconfigurable antenna of the present invention, said screen being in a transmissive mode, wherein incident RF passes through said screen as shown, in accordance with an exemplary embodiment of the present invention.
Figure 1:
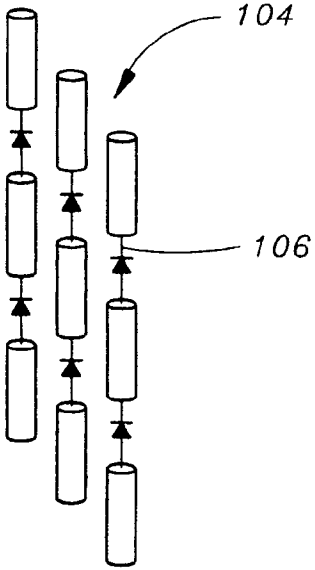
FIG. 1 is a view of a reconfigurable surface/screen of a reconfigurable antenna of present invention, said screen including integrated switches/PIN diodes in accordance with an exemplary embodiment of the present invention.

In further embodiments, the screen 104 may include/may be populated with a plurality of integrated switches 106 (as shown in FIG. 1). For example, the switches 106 may be configured for allowing an operating mode of the screen 104 to be selectively and automatically switched between a transmissive mode (as shown in FIG. 2) and a reflective mode (as shown in FIG. 3). In an exemplary embodiment, the switches 106 may be a plurality of PIN diodes and/or switching may be achieved via application of Direct Current (DC) bias (as shown in FIG. 4). Alternatively, switching may be achieved via implementation of one or more of a number of other various types of switching technologies/switches.

Figure 7:
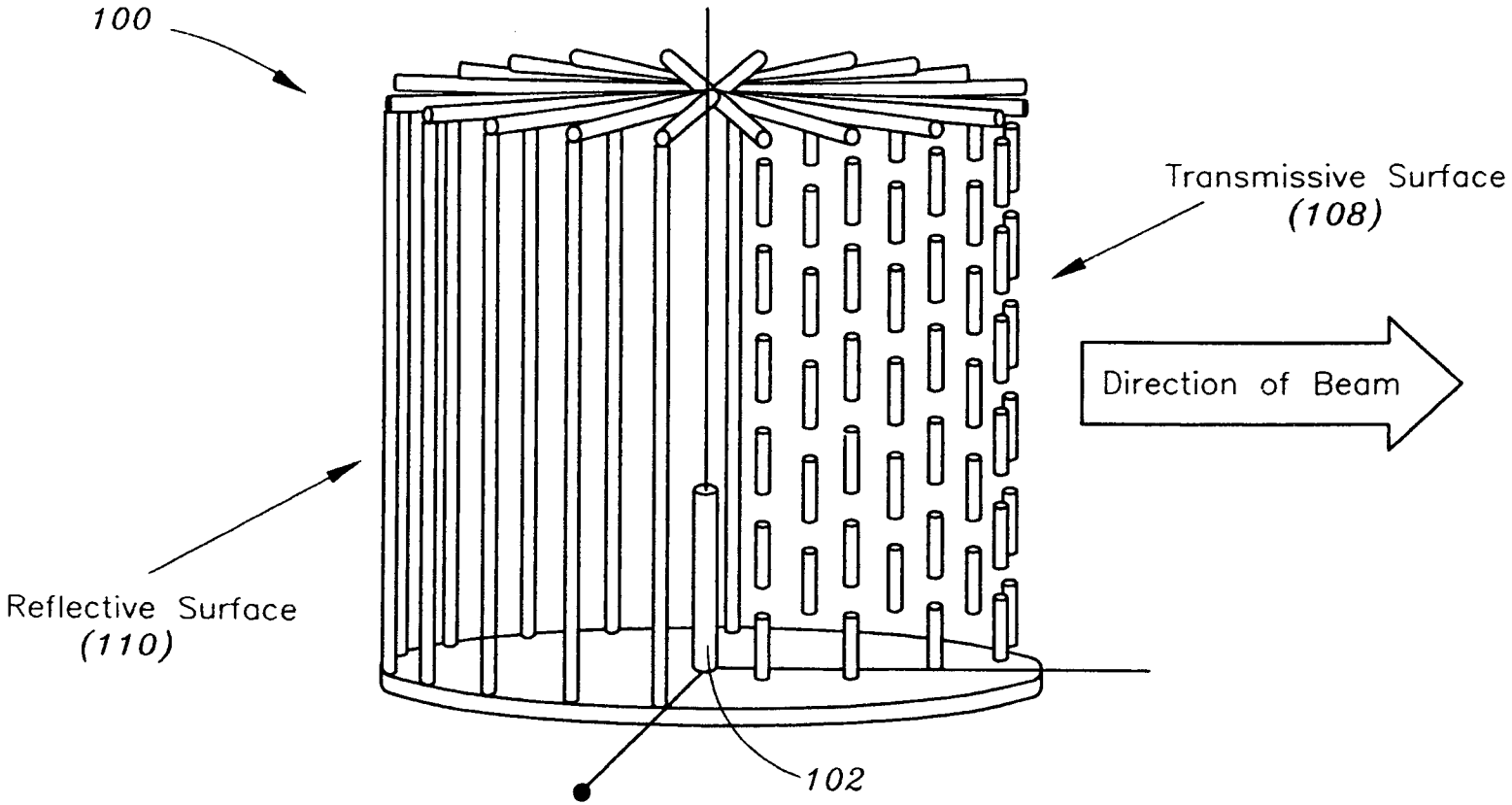
FIG. 7 is view of a reconfigurable antenna of the present invention, said reconfigurable antenna being in a reflective mode and producing/providing a directional beam as shown, in accordance with an exemplary embodiment of the present invention.
Figure 9:
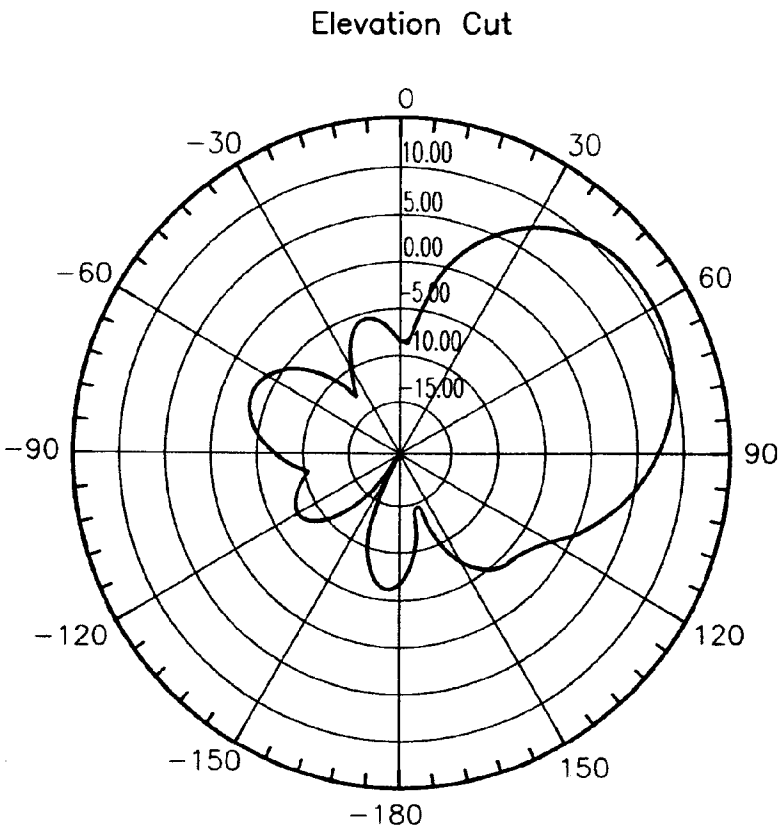
FIG. 9 is a view of a radiation pattern for a reconfigurable antenna of the present invention, said radiation pattern corresponding to an elevation cut, in accordance with an exemplary embodiment of the present invention.
Figure 8:
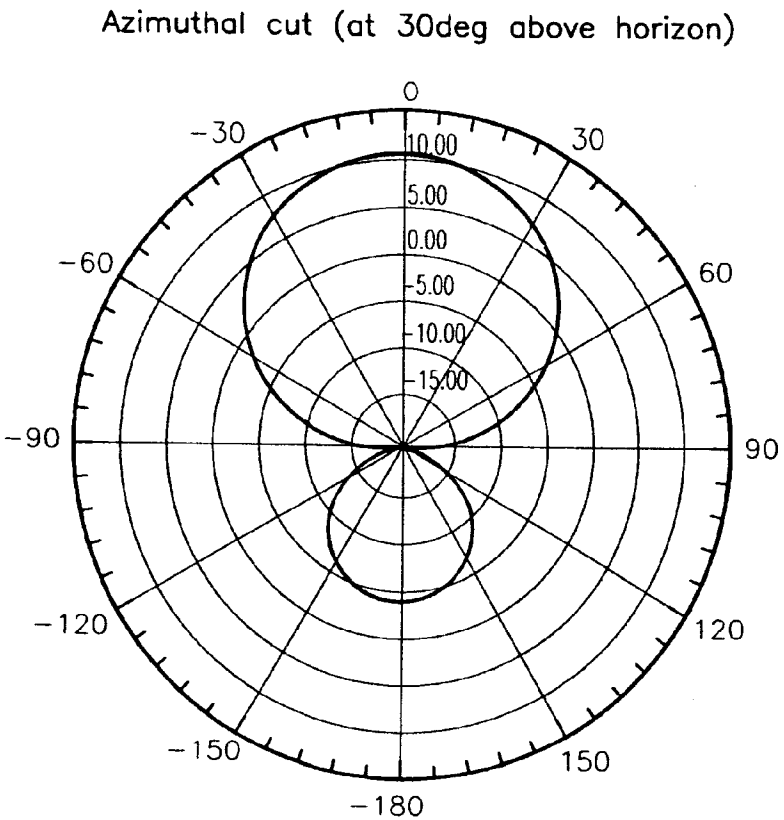
FIG. 8 is a view of a radiation pattern for a reconfigurable antenna of the present invention, said radiation pattern corresponding to an azimuthal cut at 30 degrees above the horizon, in accordance with an exemplary embodiment of the present invention.

In current embodiments of the present invention, when the screen 104 is operating in the transmissive mode, the switches 106 (ex.—PIN diodes) are not conducting, current flow along the screen 104 is prevented, and incident RF 112 passes through the screen 104 (as shown in FIG. 2). For instance, when the screen 104 is operating in the transmissive mode, the screen 104 is transmissive along its entire surface. In further embodiments, when the screen 104 is operating in the reflective mode, the switches 106 are conducting, current flow along the screen 104 is allowed/permitted, and incident RF is reflected by the screen 104 (as shown in FIG. 3). For example, when the screen 104 is operating in the reflective mode, a forward-looking surface 108 of the screen 104 may be transmissive, while a rear surface 110 of the screen (said rear surface 110 being generally opposite the forward-looking surface 108) may be reflective (ex.—may form a simple reflector dish) (as shown in FIG. 7).

Figure 5A:
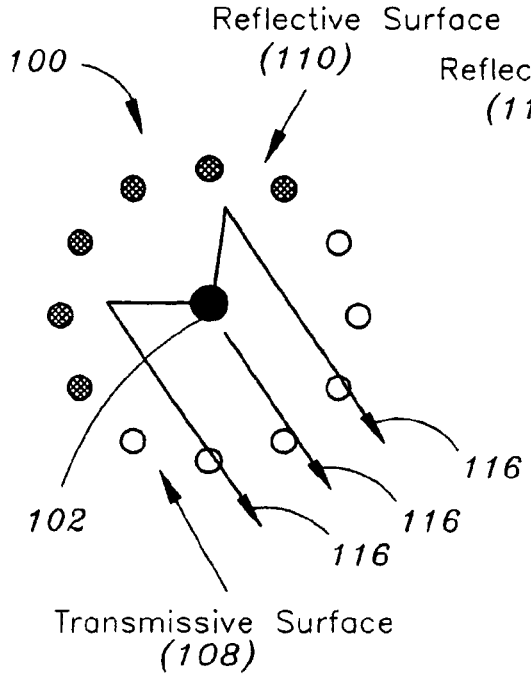
FIGS. 5A and 5B are top plan views of the reconfigurable antenna shown in FIG. 4, said top plan views showing the antenna in different positions, thereby illustrating the steerability of said antenna, said reconfigurable antenna being in a reflective mode and providing/producing directional beam (s), in accordance with an exemplary embodiment of the present invention.
Figure 5B:
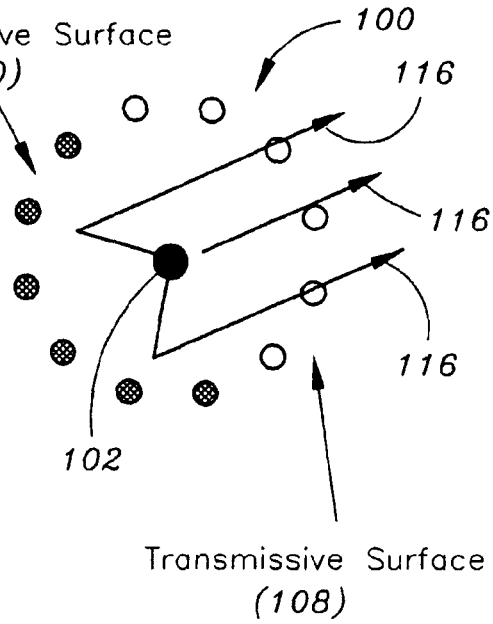
Figure 6:
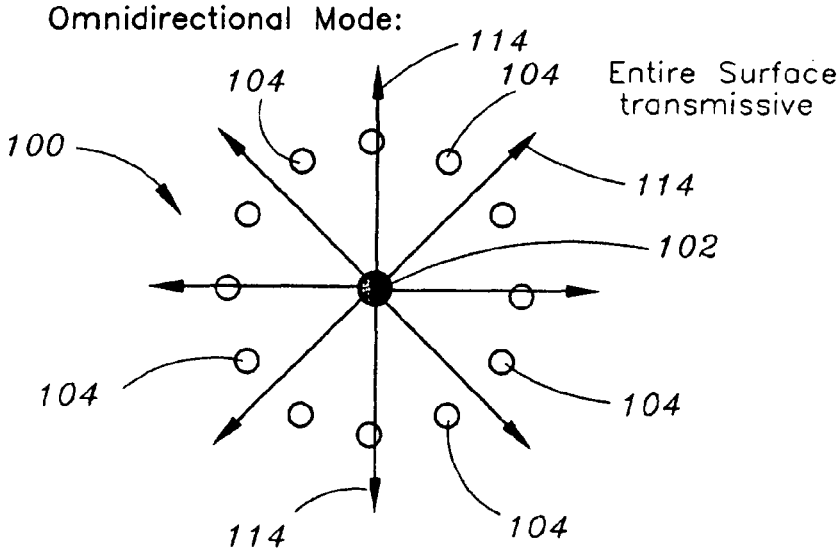
FIG. 6 is a top plan view of the reconfigurable antenna shown in FIG. 4, said reconfigurable antenna being in a transmissive mode and providing/producing omni-directional beam(s), in accordance with an exemplary embodiment of the present invention.

In exemplary embodiments of the present invention, the antenna 100 may be configured to provide/produce an omni-directional beam 114 when the screen 104 is operating in the transmissive mode/omni-directional mode (ex.—when the entire surface of the screen is transmissive) (as shown in FIG. 6). Thus, in such embodiments, the element 102 of the antenna 100 of the present invention may be an omni-directional element. In further embodiments, the antenna 100 may be further configured to provide/produce a directional beam 116 when the screen 104 is operating in the reflective mode/directional mode (as shown in FIGS. 5A and 5B). Thus, beam position is determined by the state of the reconfigurable surface/screen 104 such that, directional beams 116 may be formed by causing the rear portion/rear surface 110 of the screen 104/reconfigurable surface to be reflective (ex.—to be a reflective surface/reflector dish) and by causing the forward-looking portion/forward-looking surface 108 of the screen 104/reconfigurable surface to be transmissive, thereby forming the antenna into/causing the antenna 100 to be a steerable reflector/steerable reflector antenna/steerable surface reflector antenna 100, and further causing the directional beam 116 to be a steerable directional beam (as shown in FIGS. 5A and 5B).

In current embodiments of the present invention, steering the directional beam(s) provided/produced when the screen 104 is in reflective mode requires no change to an RF feed path of the antenna 100 (ex.—requires no phase shifters, RF switches). Thus, the antenna 100 of the present invention provides the following advantages in that said antenna: may be/may include a single RF element (thereby promoting a minimized antenna count); requires no feed manifold; requires no phase shifters; is simple in construction; is lightweight; promotes increased efficiency; promotes reduced expense (cost to construct/implement the antenna 100 of the present invention is much less than Phased Array); and promotes reduced bandwidth limitations. Further, the antenna 100 of the present invention may have a field of view of three hundred-sixty (360) degrees. Still further, the reconfigurable antenna 100 of the present invention may provide omni-directional beams and directional beams in a same aperture. In additional embodiments, the switching technology for switching the operating mode of the screen 104 between the transmissive mode and reflective mode may be a fast switching technology which is able to switch between said modes in nanoseconds (ex.—at a nanosecond-level speed). This fast switching speed of the antenna 100 of the present invention allows for Time Division Multiple Access-like (TDMA-like) channel multiplexing.

The antenna 100 of the present invention may be implemented to provide directional capability to platforms/mobile platforms (ex.—Unmanned Aerial Vehicles (UAVs), weapons/weapon systems, ground vehicles, commercial aircraft/air transport, etc.) which would otherwise be limited to Omni capabilities due to cost. Further, as mentioned above, the present invention allows for reduction of antenna count by providing a single directional antenna 100 which covers a full, 360-degree field of view.

In exemplary embodiments, the antenna 100 of the present invention may provide/produce directional beams of greater than 10 decibels Isotropic (dBi). Further, the antenna 100 of the present invention may provide increased antenna gain over omni, which may result in: lower Per Antenna (PA) power (and thus, system-wide Size Weight Power and Cooling (SWAP-C) savings); increased range; improved Lower Probability of Intercept/Lower Probability of Detection (improved LPI/LPD); and improved spectral allocation over Omni.

It is to be noted that the foregoing described embodiments according to the present invention may be conveniently implemented using conventional general purpose digital computers programmed according to the teachings of the present specification, as will be apparent to those skilled in the computer art. Appropriate software coding may readily be prepared by skilled programmers based on the teachings of the present disclosure, as will be apparent to those skilled in the software art.

It is to be understood that the present invention may be conveniently implemented in forms of a software package. Such a software package may be a computer program product which employs a computer-readable storage medium including stored computer code which is used to program a computer to perform the disclosed function and process of the present invention. The computer-readable medium may include, but is not limited to, any type of conventional floppy disk, optical disk, CD-ROM, magnetic disk, hard disk drive, magneto-optical disk, ROM, RAM, EPROM, EEPROM, magnetic or optical card, or any other suitable media for storing electronic instructions.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An antenna, comprising:

a radio frequency (RF) element;

a plurality of reconfigurable elements which surround the RF element in a generally single circular pattern, each reconfigurable element of the plurality of reconfigurable elements including at least two discrete sub-elements connected by a switch, the switch configured to cause each reconfigurable element to operate in a reflective mode or a transmissive mode, the switch is conducting when the reconfigurable element is in the reflective mode, the switch is non-conducting when the reconfigurable element is transmissive, wherein the RF element and the plurality of reconfigurable elements are configured to provide an omni-directional beam when the plurality of elements are operating in the transmissive mode and a directional beam of at least 10 dBi when a portion of the plurality of elements are operating in the reflective mode, wherein the RF element and the plurality of reconfigurable elements are further configured to steer the directional beam of at least 10 dBi by controlling at least one or more switches to cause at least one or more reconfigurable elements to operate in the reflective mode.

2. The antenna as claimed in claim 1, wherein each reconfigurable element of the plurality of reconfigurable elements is coupled to a Direct Current bias.

3. The antenna as claimed in claim 1, wherein the RF element is an omni-directional element.

4. The antenna as claimed in claim 1, wherein the RF element is a monopole.

5. The antenna as claimed in claim 1, wherein the RF element is a dipole.

6. The antenna as claimed in claim 1, wherein the antenna has a field of view of three hundred-sixty degrees.

7. The antenna as claimed in claim 1, wherein each reconfigurable element of the plurality of elements is formed of metal.

* * * * *